US010703624B2

(12) United States Patent
Merrill

(10) Patent No.: US 10,703,624 B2
(45) Date of Patent: Jul. 7, 2020

(54) HORSE BRIDLE MOUTHPIECE

(71) Applicant: Neil Merrill, Axtell, UT (US)

(72) Inventor: Neil Merrill, Axtell, UT (US)

( * ) Notice: Subject to any disclaimer, the term of this patent is extended or adjusted under 35 U.S.C. 154(b) by 77 days.

(21) Appl. No.: 15/943,459

(22) Filed: Apr. 2, 2018

(65) Prior Publication Data

US 2019/0300360 A1 Oct. 3, 2019

(51) Int. Cl.
*B68B 1/06* (2006.01)

(52) U.S. Cl.
CPC ..... *B68B 1/06* (2013.01)

(58) Field of Classification Search
CPC .... B68B 1/04; B68B 1/06; B68B 5/00; B68B 5/06; B68B 99/00
See application file for complete search history.

(56) References Cited

U.S. PATENT DOCUMENTS

| | | | | |
|---|---|---|---|---|
| 709,700 | A * | 9/1902 | Drown | B68B 1/06 54/7 |
| 1,091,683 | A * | 3/1914 | Mateer | B68B 1/06 54/8 |
| 4,005,564 | A * | 2/1977 | Simington | B68B 1/06 54/8 |
| 6,202,393 | B1 * | 3/2001 | Myler | B68B 1/06 54/7 |
| 2002/0139094 | A1 * | 10/2002 | Jonsson | B68B 1/06 54/7 |
| 2018/0305198 | A1 * | 10/2018 | Cross | B68B 1/06 |

* cited by examiner

*Primary Examiner* — Daniel J Colilla
(74) *Attorney, Agent, or Firm* — J. Todd Rushton

(57) ABSTRACT

The disclosure of the present invention relates to a HORSE BRIDLE MOUTHPIECE or more specifically to a horse bridle mouthpiece having side shanks and a moveable intermediate link connected to the ends of the side shanks using a ring and ball joint fitted into a tapered slot. The ring and ball joint configured to provide optimal control of the mouthpiece to convey clear signals to the horse and provide an improved fit and comfort.

9 Claims, 3 Drawing Sheets

HORSE BRIDLE MOUTHPIECE

The present application is related to U.S. patent application Ser. No. 15/856,378 for HORSE BRIDLE BIT AND METHOD OF USE, filed Dec. 28, 2017, by Neil Merrill, the disclosure therein incorporated by reference.

BACKGROUND

Horse bridle bits having a multipart mouthpiece such as in a snaffle bit will include side bars and a moveable central link which provides some give or relief as it rests on the tongue of the horse. However, when the mouthpiece is configured having the side bar rigidly attached to the bit shanks in order to impart a rotational movement on the side bars when the bit shanks are pulled back in a whoa or a turn command. The rotational movement will cause the side bars to rise up or stand in a V configuration sending an aggressive signal to the horse by impinging on the roof of the horse's mouth or by pinching the horse's tongue and gum bars with a nut cracker effect.

A curb bit, most typically, is a horse bridle bit having a rigid mouthpiece which has a bend, or port, formed in the mouthpiece. The bend is configured to lay flat on the horse's tongue when the reins are held in neutral position but will rotate up into the roof the horse's mouth when the reins are pulled in a turn or whoa command. Any mouthpiece having a rigid connection to the bridle bit side shanks has the potential to impart significant pressure on a horse's tongue and lips during an aggressive rein command such as those given used for rodeo or barrel racing.

If a mouthpiece imparts pain, a horse may choose to fight the command by bucking, or otherwise misbehaving, or may choose to under-perform in order to avoid situations where it expects to feel pain.

What is needed is horse bridle mouthpiece that has the ability to covey clear signals to the horse, but also having control of the shape, or configuration, of the mouthpiece in order to avoid causing the horse unnecessary pain.

SUMMARY OF THE INVENTION

The disclosure of the present invention relates to a HORSE BRIDLE MOUTHPIECE or more specifically to a horse bridle mouthpiece having side shanks and a moveable intermediate link connected to the ends of the side shanks using a ring and ball joint fitted into a tapered slot. The ring and ball joint configured to provide optimal control of the mouthpiece to convey clear signals to the horse and provide an improved fit and comfort.

One embodiment of the present invention or horse bridle mouthpiece includes two side bars, each having a first end connected to the side shanks of the horse bridle bit assembly using a moveable joint having the ability to articulate perpendicular to the longitudinal axis of the side shanks but also having the capacity to impart a rotational movement into the mouthpiece side bars when such as command as whoa or stop is conveyed through the reins and into the side shanks. One embodiment of such a moveable joint is disclosed in U.S. patent application Ser. No. 15/856,378 for HORSE BRIDLE BIT AND METHOD OF USE as incorporated herein. However, it is recognized that such other joints having the capacity to articulate perpendicular to the side shanks and also convey a rotational component may be presently available or may yet be developed. The second end of the side bars is an articulating end formed as substantially as a flattened ring having face surfaces, a side surface, and an articulation cutout formed through the articulation end from the first face surface to the second face surface. The side of the articulating end is formed as a substantially flat surface which is perpendicular to the face surface. The side of the articulating end having a distal end or a nose end. The articulation cutout formed having a substantially circular ball cutout portion and a tapered slot portion extending back from the ball cutout. The tapered slot portion terminating having a flat base or the composite image forming a frustotriangular shape similar to the profile of an ice cream cone.

In one embodiment a linear central link is formed to connect with the side bars forming a three-bar or a multi-piece mouthpiece. In another embodiment the central link may be formed as a bar configured as semi-circle or a port bit mouthpiece. Both embodiments having opposing substantially flat face portions and a substantially flat side portion forming the thickness of the central link Both embodiments are configured to act to connect the side bars substantially in the middle of the mouthpiece, the central link having a center portion and articulation ends having an articulation cutout formed reciprocal to the articulation cutout formed in the side bars. The central link articulation cutout having a semi-circular ball cutout portion, a tapered slot portion extending back from the ball cutout, and a substantially flat base portion terminating the tapered slot portion. The central link articulation cutouts formed as an inverse to the articulation cutouts of the side bars. The width of the flat base portions is configured to be slightly wider than the thickness of its reciprocal piece.

The articulation ends of the side bars and the articulation ends of the central link are configured to interlock perpendicular to its reciprocal cutout with a ball bearing or a standoff ball placed in the semicircular ball cut outs. The standoff ball allows for controlled articulation of the joint by providing a bearing surface and by forcing the distal end of the side bars into the tapered slots of the central link and the distal ends of the central link into the tapered slot of the side bar. The overall movement in the joint can be controlled by changing the amount of clearance between the tapered slot and the faces of the articulation ends. The amount of clearance can be changed by opening of closing the angle of the taper, changing proportions of the tapered slot or by changing the thickness of the articulation ends. The movement of the joint can also be changed by modifying or base end of the tapered slot to change the amount of interference between the base end and the distal end of the articulation end. This modification can influence how the multi-piece mouthpiece is positioned in the horse's mouth, there should be enough play in the mouthpiece to allow it to conform to the shape of the mouth, or to drape comfortably over the horse's tongue, but it should not be so slack as to sag when the horse's head is tilted, forcing the horse to "carry" the mouthpiece. In one embodiment the cutout base includes a cutout relief, to about one half of the cutout base, the cutout relief allowing the center link to rise up toward the roof of the horse's mouth when side shanks are rotated down but the flat portion of the cutout base prevents the center link from sagging or being forced down into the horse's tongue.

In another embodiment where the central link is a semi-circular port bit, downward rotation of the bridle bit side shanks, as is a turn or a whoa command, will cause the central link to stand and intrude toward the roof of the horse's mouth.

BRIEF DESCRIPTION OF DRAWINGS

The following description of the embodiments can be understood in light of the Figures which illustrate specific aspects of the embodiments and are part of the specification. Together with the following description, the Figures demonstrate and explain the principles of the embodiments. In the Figures the physical dimensions of the embodiment may be exaggerated for clarity. The same reference numerals or word descriptions in different drawings represent the same element, and thus their descriptions may be omitted.

DETAILED DESCRIPTION OF DRAWINGS

Figure 1:
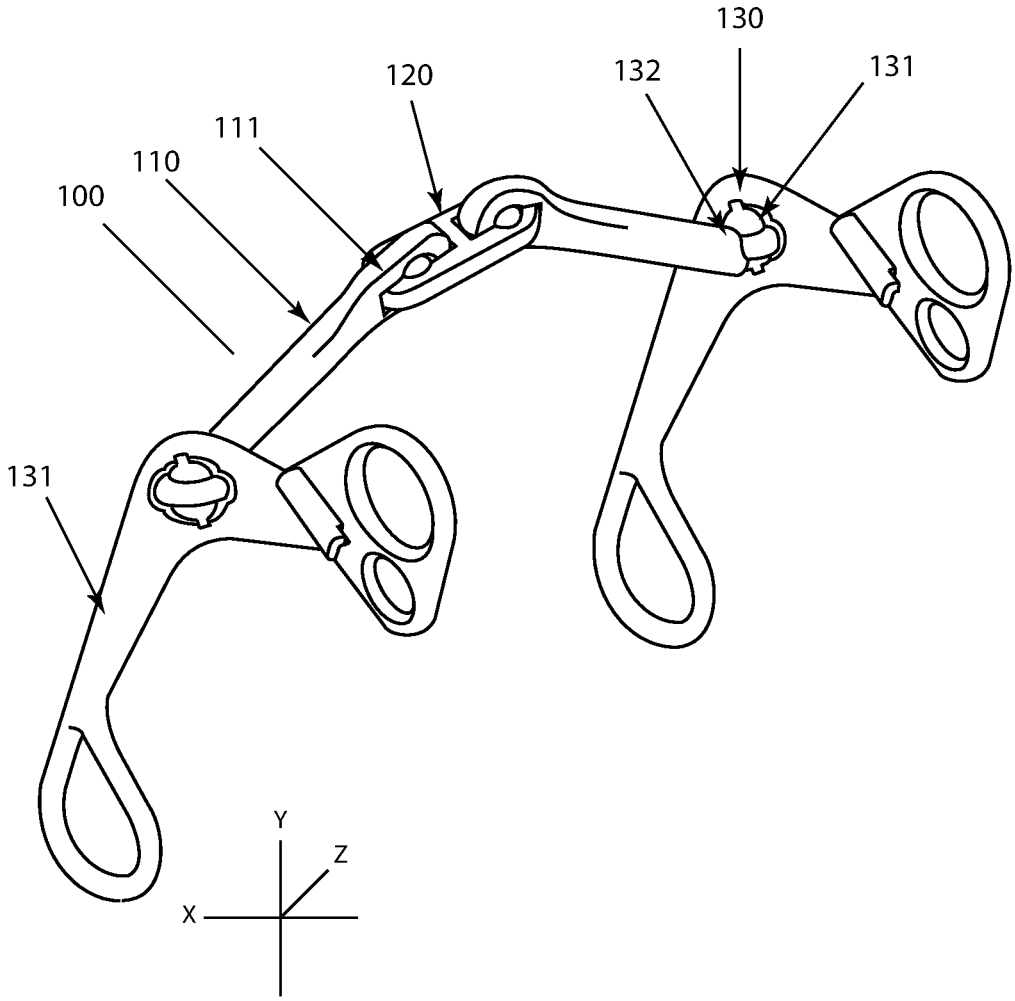
FIG. 1, a perspective view of a horse bridle bit.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

In describing and claiming the present disclosure, the following terminology will be used in accordance with the definitions set out below. As used in this specification and the appended claims, the singular forms "a," "an," and "the" include plural referents unless the context clearly dictates otherwise. As used herein, the terms "comprising," "including," "containing," "characterized by," "having," and grammatical equivalents thereof are inclusive or open-ended terms that do not exclude additional, unrecited elements or method steps.

The present invention will be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art.

An embodiment of a horse bridle bit mouthpiece 100, shown in FIG. 1, including side bars 110, a central link 120, and the bridle bit side shanks 131. Side bars 110 including a first articulation end 111 attached to the central link 120 and a second shank end 132 configured to be attached to the side shanks 131 using a moveable joint 130. The moveable joint 130 configured to allow the side bars 110 to move perpendicular to the longitudinal axis of the side shanks 131 but also allowing the side shanks 131 to impart a rotational moment into the sidebars 110 and manipulated the configuration of the mouthpiece 100.

Figure 2A:
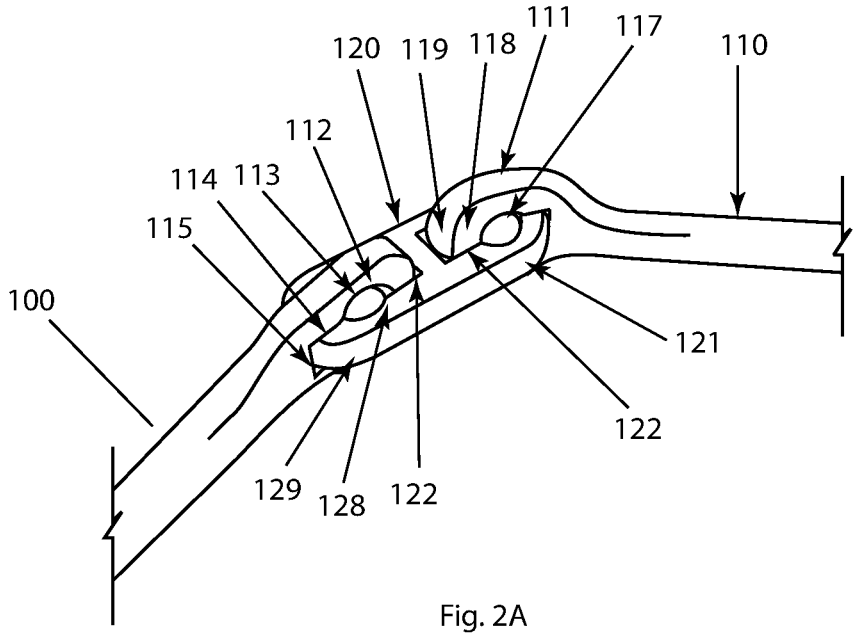
FIG. 2A, is a perspective view of a mouthpiece having a straight central link.
Figure 2B:
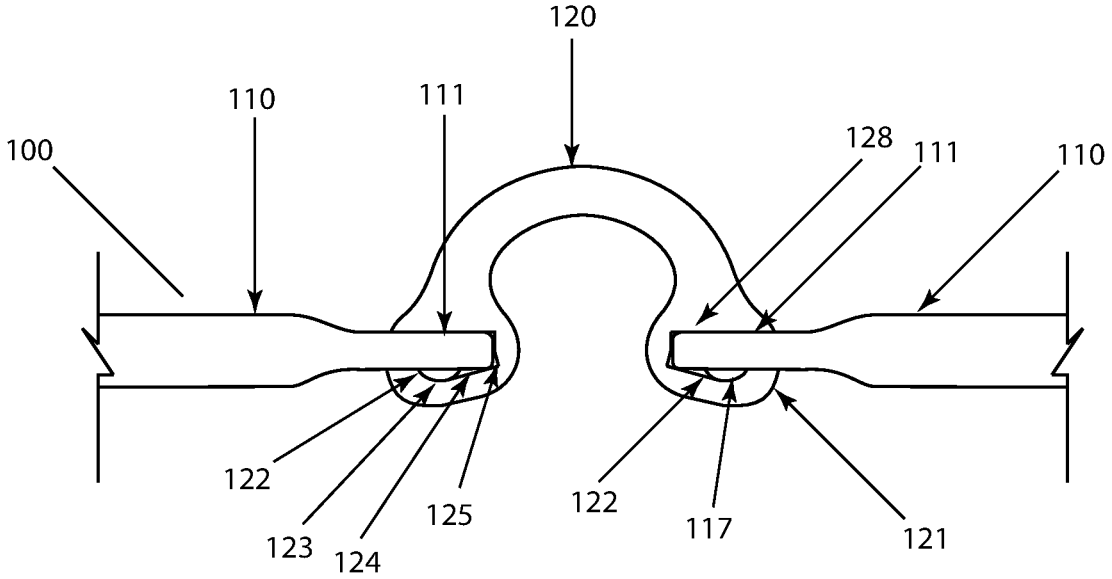
FIG. 2B, is a top view of a mouthpiece have a port central link, FIG. 3A, a top view of the side bar articulation end.

FIGS. 2A and 2B are embodiments of the mouthpiece 100 having side bars 110 and a central link 120. Side bars 100 having an articulation end 111 forming a ring including two opposing faces 118, and a substantially flat side surface 119. An articulation cutout 112 is formed through faces 118, the articulation cutout having a ball cutout 113 with a tapered slot portion 114 extending down to a flat cutout base 115. The central link 120 also having articulation ends 121 having faces 128 and a side surface 129. The articulation ends 121 of the central link 120 having an articulation cutout 122 formed reciprocal to the articulation cutout 112 formed in the side bars 110. Articulation cutouts 122 having a ball cutout 123 with a tapered slot cutout 124 extending down to a flat base cutout 125. Standoff ball 117 is configure to hold the articulation end 111 of the side bar 110 into the tapered slot cutout portion 124 of the articulation cutout 122 formed in the central link 120, and hold the articulation end 121 of the central link 120 into the tapered slot cutout portion 114 of the articulation cutout 112 of the side bar 110. As shown in FIG. 2A the central link 120 is linear bar style and the central link 120 is a port as shown in FIG. 2B.

Figure 3A:
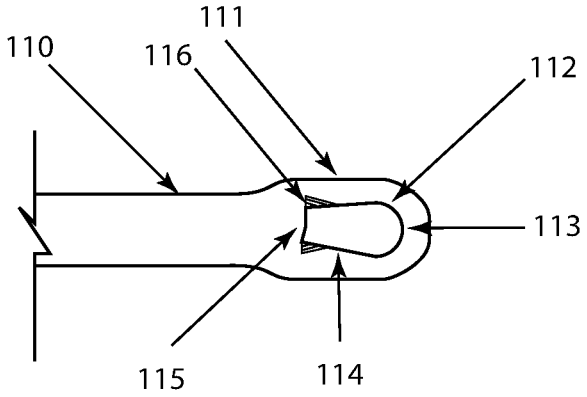
FIG. 3B, is an explode view of the side bar articulation end, standoff ball and port central link, and, FIG. 3C is top view of a partially assembled mouthpiece.
Figure 3B:
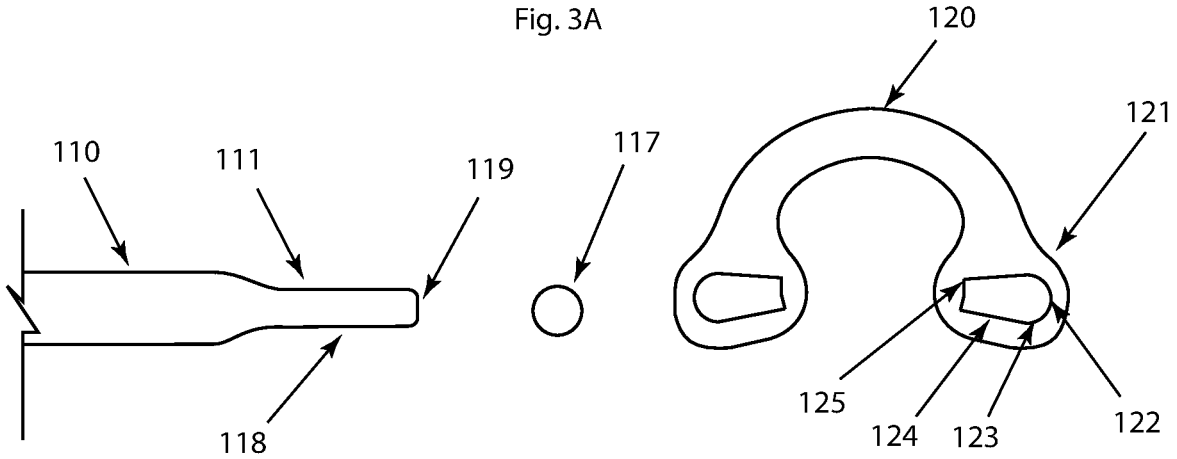
Figure 3C:
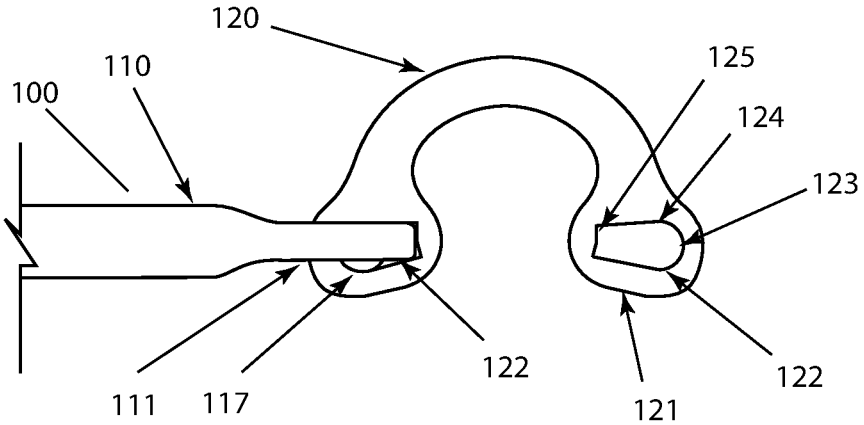

FIGS. 3A through 3C are one embodiment of a horse bridle mouth piece including a sidebar 110 having an articulation end 111 including an articulation cutout 112 formed through the articulation end 111. The articulation end 111 being a narrowed portion having two substantially flat faces 118 and a side surface 119 formed perpendicular to the side surfaces 118. The articulation cutout 112 including a ball cutout portion 113 with a tapered slot portion 114 extending down to a substantially flat base 115 of the articulation cutout 112. The central link 120 formed having articulating ends 121 including articulation cutouts 122 formed to correspond reciprocally with the articulation cutout 112 formed in the articulation ends 111 of the side bars 110. The articulation cutouts 122 having a ball cutout 123 with a tapered slot portion 124 extending down to a flat base portion 125. A standoff ball 117 configured to fit into the ball cut outs 113, 123 forcing the articulation end 111 of the side bar 110 into the tapered slot 124 of the central link 120 and the articulation end 121 of the central link 120 into the tapered slot 114 of the side bar 110. The standoff ball 117 also works to provide a bearing surface in the resulting joint. The overall movement in the joint can be manipulated by varying the width of the tapered slots 114, 124 or by varying the thickness or width of the articulation ends 111, 121. More precise control of the joint flexure can be achieved by creating a cutout relief 116 (shaded area FIG. 3A) designed to reduce interference between the tapered slots 114, 124 and the articulating end sides 118, 128. The concept of a cutout relief 116 is equally applicable to the articulation ends 121 of the center link 120.

The invention claimed is:

1. A horse bridle mouthpiece comprising;

a pair of side bars,
  each side bar having,
    a shank end,
    an articulation end,
      an articulation cutout formed through the articulation end,
        each articulation cutout having,
        a ball cutout,
        a tapered slot portion, a central link,
  the central link having,
    a first end and a second end,
    an articulation cutout formed in each end,
      each articulation cutout having,
        a ball cutout,
        a tapered slot portion, a standoff balls, the articulation end of each side bar configured to interlock with a respective one of the articulation cutouts formed in the ends of the central link, wherein, each of the standoff balls is installed in a respective one of the ball cutouts of the articulation ends of the side bars and in a respective one of the ball cutouts of the ends of the central link, and, wherein, the articulation end of each side bar extends into a respective one of the tapered slots of the articulation cutout formed in each of the ends of the central link, and, each of the ends of the central link extends into a respective one of the tapered slots of the articulation cutout formed in the articulation end of the side bars.

2. The mouthpiece of claim 1 wherein, the central link is a linear bar.

3. The mouthpiece of claim 1 wherein, the central link is a curved port.

4. The mouthpiece of claim 1 wherein, the articulation end of the side bars is flattened having a first face and a second face.

5. The mouthpiece of claim 4 wherein, one of the first face and a second face contacts an inside surface of the tapered slot portion of the articulation cutout formed in one of the ends of the central link.

6. The mouthpiece of claim 1 wherein, the tapered slot portion of the articulation cutout of the central link is wider than the thickness of the articulation end of the side bar.

7. The mouthpiece of claim 1 wherein, the tapered slot portion of the articulation cutout of the side bars is wider than the thickness of the central link.

8. The mouthpiece of claim 1 including, a relief cutout formed in the tapered slot of the articulation cutout of the articulation end of the side bar.

9. The mouthpiece of claim 1 including, a relief cutout formed in the tapered slot of at least one of the articulation cutouts of the central link.

* * * * *